US005865369A

United States Patent [19]

Fisher et al.

[11] Patent Number: 5,865,369

[45] Date of Patent: Feb. 2, 1999

[54] RECYCLING HIGH PRESSURE STEAM FOR HEATING PURPOSES

[76] Inventors: Gerald Fisher, 111 E. 80th St., New York, N.Y. 10021; Joseph Manaseri, 1 Kendrick La., Dix Hills, N.Y. 11746

[21] Appl. No.: 546,777

[22] Filed: Oct. 23, 1995

[51] Int. Cl.[6] ..... F24D 1/00

[52] U.S. Cl. ..... 237/13; 237/67; 165/103

[58] Field of Search ..... 237/13, 67; 165/103, 165/107 R, 76

[56] References Cited

U.S. PATENT DOCUMENTS

| | | | |
|---|---|---|---|
| 987,871 | 3/1911 | Gifford . | |
| 1,941,496 | 1/1934 | Schleh . | |
| 4,079,885 | 3/1978 | Decker . | |
| 4,196,776 | 4/1980 | Fallon, Jr. et al. | 165/76 |
| 4,214,450 | 7/1980 | Nagashima et al. | 60/648 |
| 4,231,842 | 11/1980 | Ojala | 162/47 |
| 4,445,461 | 5/1984 | Farnia | 122/7 R |
| 4,572,429 | 2/1986 | Huffman, Jr. et al. . | |
| 4,638,765 | 1/1987 | Skinner | 122/7 R |
| 4,873,840 | 10/1989 | Gilliusson | 237/13 |

*Primary Examiner*—Harold Joyce
*Assistant Examiner*—Derek S. Boles
*Attorney, Agent, or Firm*—Levisohn, Lerner, Berger & Langsam

[57] ABSTRACT

Apparatus for diverting and recycling exhaust steam used in manufacturing processes to provide steam for conventional heating equipment.

12 Claims, 4 Drawing Sheets

STEAM SAFETY VALUE 12
CHECK VALVE 13
BALL VALVE 10
STEAM PRESSURE REGULATOR 11
9
TEE JOINT 8
2

RECYCLING HIGH PRESSURE STEAM FOR HEATING PURPOSES

BACKGROUND OF THE INVENTION

Recirculated or recycled steam is used in a number of manufacturing processes. For example, in the manufacture of corrugated cardboard and paper, high-pressure steam is used to heat the drums, plates, and other parts of the corrugator machinery to a temperature sufficient to combine the constituents of corrugated paper into a unified whole. After flowing through the corrugator machinery, the exiting exhaust steam is recycled in a closed system back to a return tank and on to the boiler which generates the high pressure steam used to heat the corrugator machinery.

The present invention is directed to an apparatus and system for diverting and using exhaust steam from manufacturing processes to heat local buildings, and thereby reduce heating costs without sacrificing manufacturing efficiency. Although the diversion and use of exhaust steam in accordance with the present invention is described for purposes of example in the context of the manufacture of corrugated paper, one of ordinary skill will readily appreciate the use of this invention in other industrial settings.

As described in greater detail below, the diversion and use of exhaust steam in corrugated paper processes is accomplished by installing a T-joint or similar pipe fitting at a convenient point in the conduit or pipe between the corrugator machinery and the boiler return tank. One path of the T-joint allows the exhaust steam to proceed in the conventional direction to the return tank; the other path, coupled to suitable piping or other conduit, leads to environmental, i.e., commercial or residential steam heating equipment (e.g. radiators or blowers).

An on-off ball valve, steam pressure regulator, steam safety valve, and check valve are installed between the T-joint and the conventional steam heating equipment. When opened, the on/off ball allows the exhaust steam to proceed toward the conventional steam heating equipment. The steam pressure regulator reduces and limits the pressure of the exhaust steam to approximately 5–15 pounds per square inch ("psi") so that it may used for conventional heating purposes. The safety valve prevents the reduced pressure of the exhaust steam from exceeding the level set by the steam pressure regulator. The check valve prevents the low-pressure exhaust steam from flowing backward through the on-off valve and back to the T-joint. After the steam has cleared the check valve and flowed through conventional heating equipment it, too, can be recycled back to the boiler for regeneration and use by the corrugator machinery.

DESCRIPTION THE PRIOR ART

The applicant has discovered that other patents have issued on apparatus and methods of using steam and other energy sources employed in industrial processes for conventional heating purposes. See U.S. Pat. Nos. 4,572,429, 4,079,885, 1,941,496, and 987,871. U.S. Pat. No. 987,871 appears to be most pertinent to the present invention as it contemplates the use of blow-off water and steam employed to clean and fill locomotive boilers to facilitate heating the locomotive roundhouse and associated buildings. This patent discloses that hot water is used in railroad roundhouses to wash out and refill locomotive boilers. One object of the '871 patent is to utilize the blow-off water and steam from locomotive boilers as the heating medium in the roundhouse in the wintertime. This patent, however, contains no teaching or suggestion of the apparatus of the present invention for diverting and reducing the pressure of exhaust steam resulting from manufacturing processes to provide an efficient, continuous, and low-cost source of steam for conventional heating equipment, and the selective recycling of such steam for reuse in the manufacturing process. Nor does U.S. Pat. No. 987,871 teach or suggest the steam regulator and valve combination of the present invention.

U.S. Pat. No. 4,572,429 shows a method and apparatus for conserving energy and improving working conditions in a sock finishing factory. According to the described method and apparatus, boarding machines used in the treatment of socks are electrically heated to a temperature of about 250° F. The heat generated by the boarding machines is then, according to the invention, recaptured and used as heat for a dye house. In addition, the recaptured heat is used for the seasonal heat needed for a warehouse. Here, again, there is neither a teaching nor a suggestion of converting high pressure exhaust steam to low pressure steam for a heating system with a valve therebetween.

U.S. Pat. No. 1,941,496 relates to an "economizer" where the waste heat of the flue gas of heating plants may be utilized to heat air for later use in rooms of buildings. This is a mechanism for recycling the heat ordinarily wasted as flue gases as they escape through chimneys such that the heat is recaptured and redirected back toward providing heat to the building. This patent is obviously not pertinent to the present invention.

Nor is U.S. Pat. No. 4,079,885 relevant, as it relates to an apparatus and method of utilizing otherwise lost waste heat from residential pressure boilers and hot air furnaces. This inventor contemplates the passing of the waste heat around a heat exchanger to reduce the stack effluent gas to a temperature of 120° or less. The heat exchanger then transfers the heat back to the heating furnace.

DETAILED DESCRIPTION OF THE INVENTION

Figure 1:
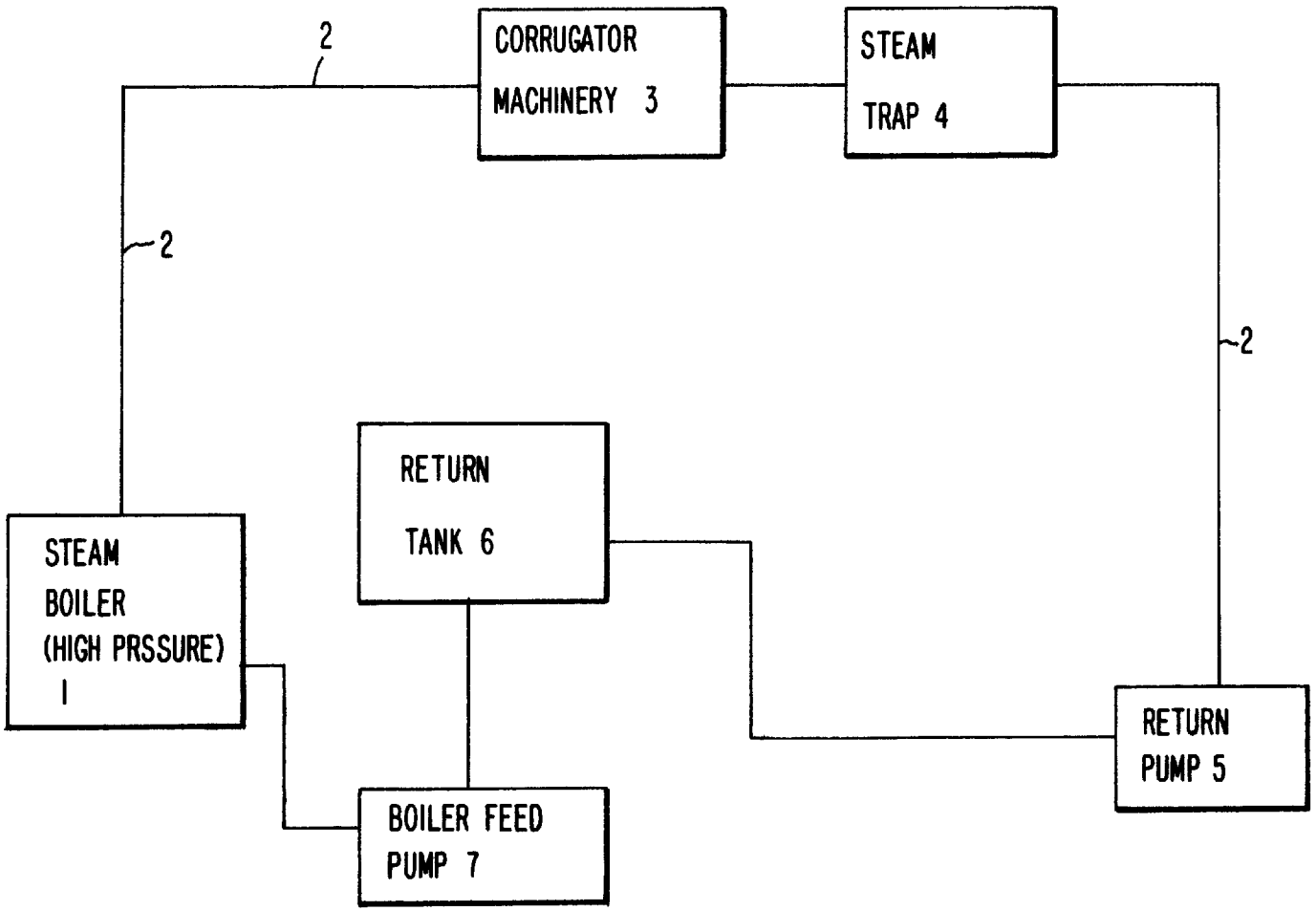
FIG. 1 is a schematic representation of the closed steam supply and circulation system used in the manufacture of corrugated paper.

Referring, by way of introduction, to the conventional steam supply and circulation system used in the manufacture of corrugated paper depicted in FIG. 1, the steam boiler 1 produces steam having a relatively high pressure of approximately 150 psi. The high pressure steam produced by the boiler 1 is conveyed by pipe 2 to the corrugator machinery 3. The corrugator machinery includes numerous rollers, plates, and other equipment, which are not depicted in FIG. 1 for sake of simplicity. The high pressure steam emanating from the boiler 1 circulates through and heats the rollers, plates and other parts of the corrugator machinery 3 to the temperature necessary to facilitate the combining of the top, bottom and filler elements of corrugated paper into a unified whole. After exiting the corrugator machinery 3, the steam flows and is collected by steam trap 4, where the pressure of the exhaust steam is reduced to approximately 30 psi. From steam trap 4, the steam flows to a return pump 5 which sends the exhaust steam to the return tank 6 where the steam is condensed into water. The condensated water from the return tank 6 is then returned to steam boiler 1 by boiler feed pump 7, and the cycle is continued.

Figure 2:
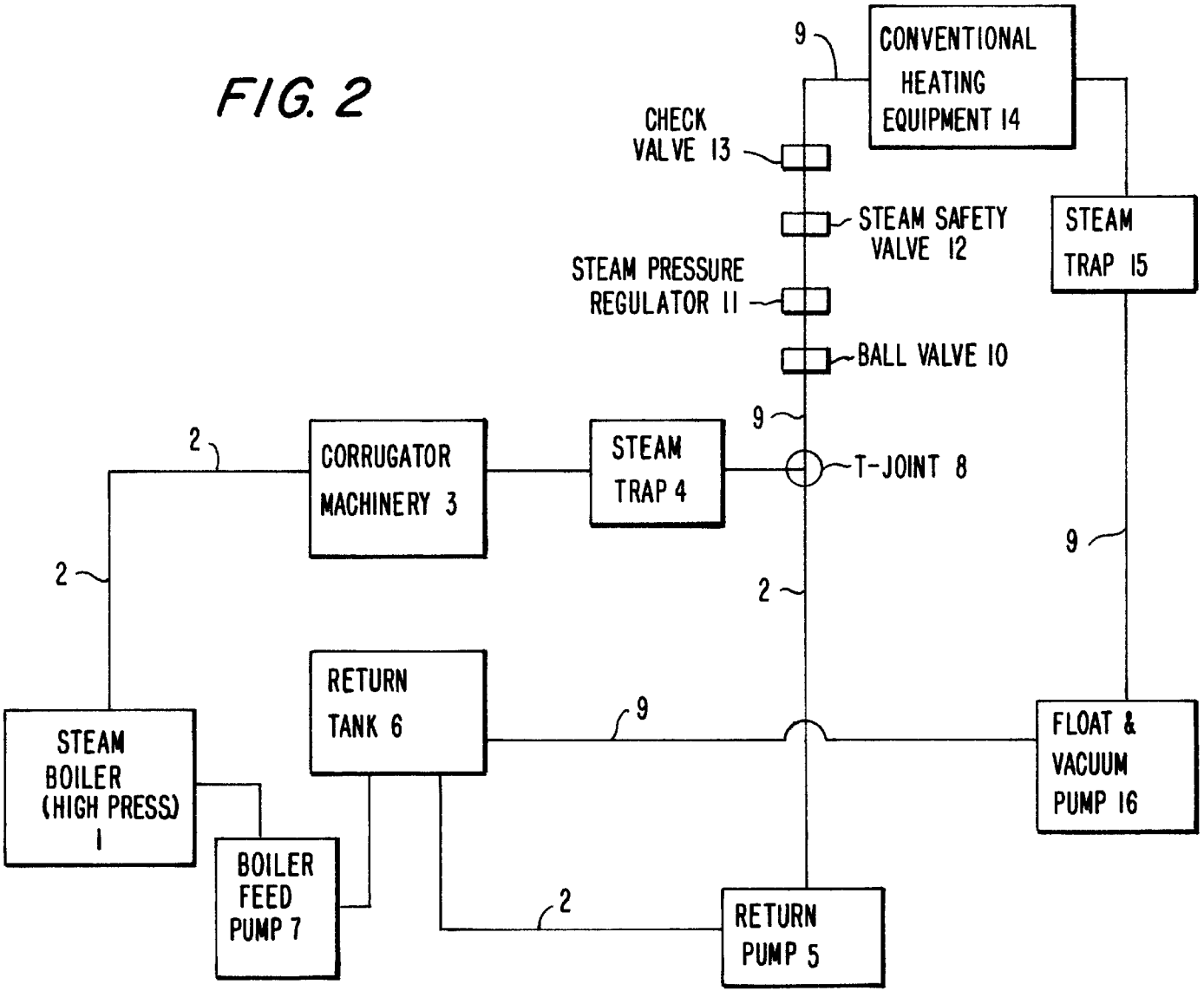
FIG. 2 is a schematic representation of the disclosed apparatus for using exhaust steam from a manufacturing process for conventional heating purposes and selectively reusing said steam for further manufacturing purposes in connection with manufacture of corrugated paper.

FIG. 2 depicts the method and apparatus of the present invention for using the exhaust steam from the corrugator machinery to heat the corrugator factory and, possibly, other buildings. As can be readily seen, a T-joint 8 is installed at a convenient point in the pipe 2 between the steam trap 4 and return pump 5. The T-joint 8 thus serves to allow the exhaust steam to proceed along pipe 2 to the boiler 1 and, when the on-off ball valve 10 is open, along pipe 9 to the conventional heating apparatus 14.

Installed downstream of T-joint 8 in pipe 9 are an on/off ball valve 10, steam pressure regulator 11, steam safety valve 12, and a check valve 13. When opened, the ball valve 10 allows the exhaust steam to proceed to the conventional heating apparatus 14 after passing through the steam pressure regulator 11, safety valve 12, and check valve 13. The steam pressure regulator 11 reduces the pressure of the exhaust steam to a pressure compatible with that of the conventional heating equipment 14, generally less than approximately 15 psi. The steam safety valve 12 ensures that the pressure of the heating steam does not exceed the level set by the steam pressure regulator 11. Check valve 13 prevents any backward flow of the heating steam to pipe 2. After passing through check valve 13, the heating steam is supplied to conventional steam heating equipment 14 (e.g. radiator, blower) located in the corrugator plant or other buildings to heat said structures.

After flowing through the conventional heating equipment 14, the steam proceeds to a steam trap 15 and then on to a float and vacuum pump 16. The float and vacuum pump 16 transfers the steam to return tank 6 where, as described above, it is condensed and resupplied to boiler 1 for regeneration as high pressure steam and use by the corrugator machinery 3.

Figure 3:
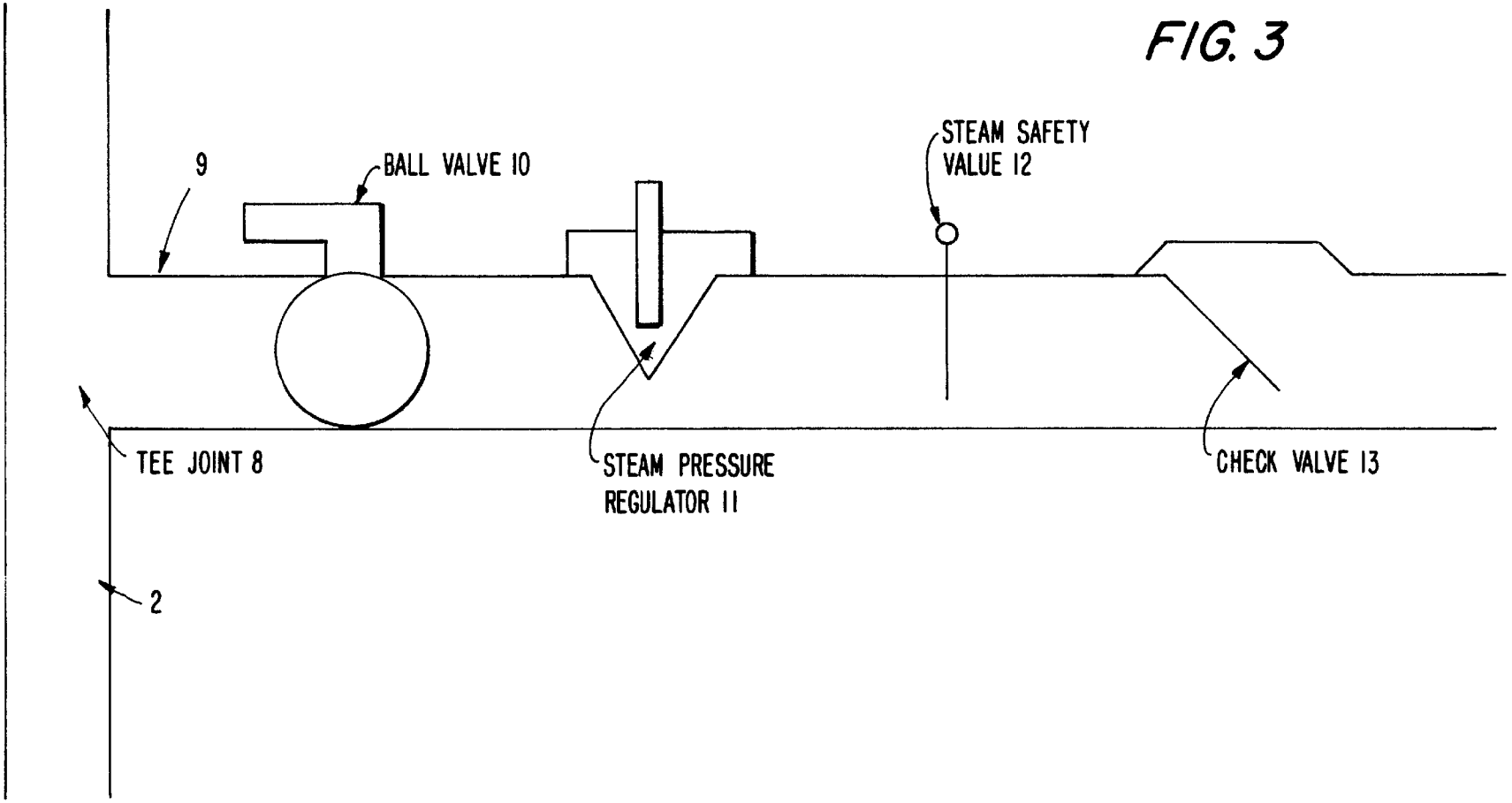
FIG. 3 depicts the T-joint, valves, and steam regulator apparatus of the present invention.

FIG. 3 shows more detail of the T joint 8, ball valve, steam pressure regulator 11, steam safety valve 12, and check valve 13.

Figure 4:
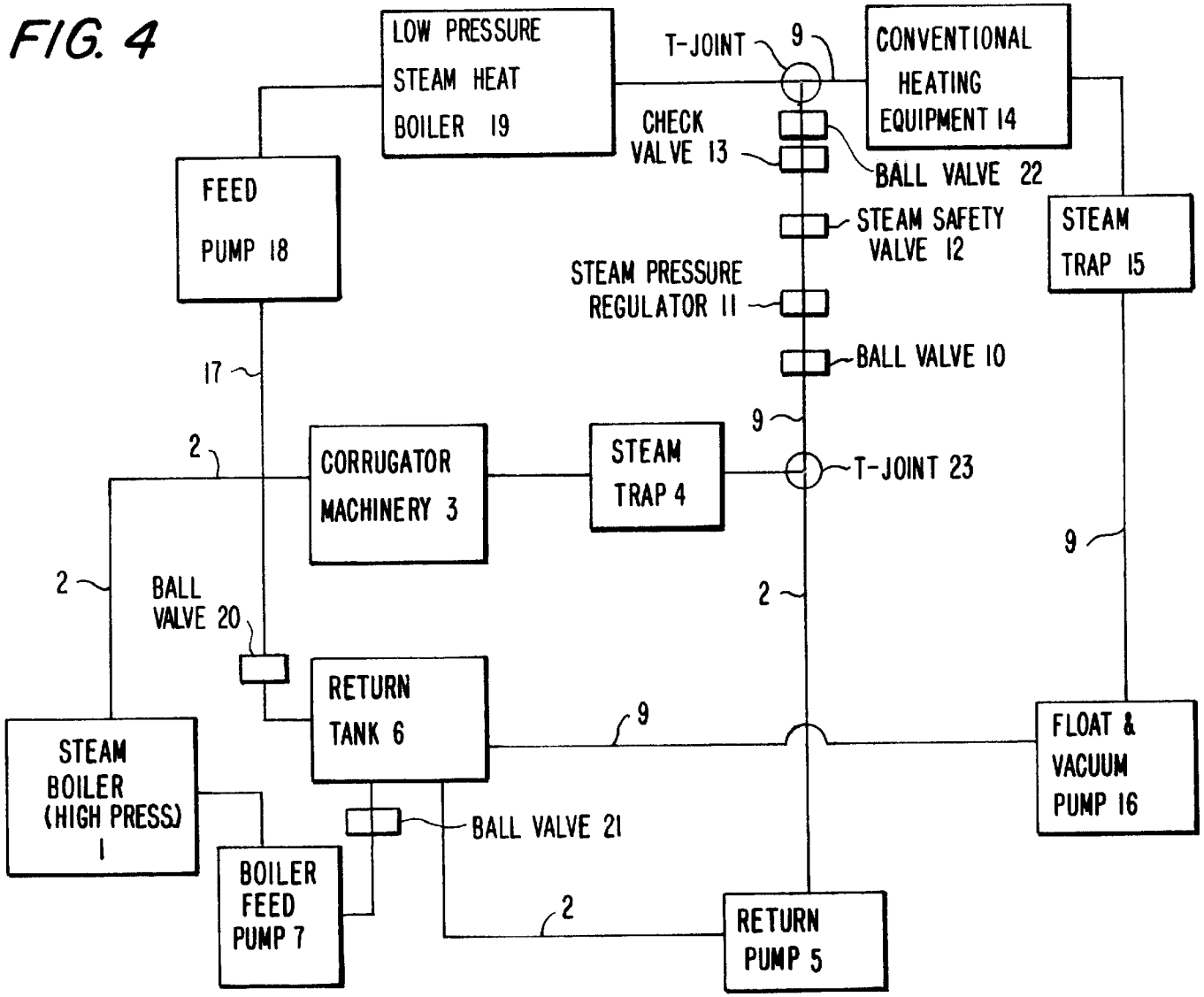
FIG. 4 depicts a schematic representation of the disclosed apparatus used in conjunction with conventional low pressure steam heat apparatus to provide heat when exhaust steam from a manufacturing process is not available.

The foregoing disclosed apparatus may also be used in conjunction with a conventional low pressure steam heat boiler and associated apparatus to provide environmental heat when the corrugator machinery is not in use and exhaust steam is unavailable. As depicted in FIG. 4, this is accomplished by running a pipe or other suitable conduit 17 from the return tank 6 to a feed pump 18 and on to a low pressure steam heat boiler 19. On-off ball valves 20 and 21 are inserted at convenience points in the pipe 17 between the return tank 6 and feed pump 18, and in the pipe 2 between return tank 6 and high pressure boiler feed pump 7. An on-off ball valve 22 is installed downstream of check valve 13 in pipe 9, and a T-joint 23 is installed in pipe 9 at a convenient point between ball valve 22 and conventional heating equipment 14. Finally, pipe 17 is installed between low pressure steam boiler 19 and T-joint 23. As can readily be seen, steam generated by low pressure heat boiler 19 may be supplied to the conventional heating equipment 14 and recycled when the corrugator machinery is not in use by opening ball valve 20 and closing ball valves 19 and 21.

Although the invention is described in regard to a specific embodiment, this description is not meant as a limitation as further variations or modifications may be apparent or may suggest themselves to those skilled in the art. It is intended that the present application covers such variations and modifications as fall within the scope of the appended claims.

What is claimed:

1. Apparatus for diverting exhaust steam from existing manufacturing machinery utilizing recycled high pressure steam in the manufacture of products by said existing manufacturing machinery to conventional environmental heating equipment, comprising:

a source of exhaust steam taken downstream from said manufacturing machinery;

diverting means, connected to said exhaust steam source, for diverting at least some of said exhaust steam to a conduit;

an on-off valve installed in said conduit, downstream of said diverting means, to selectively allow the flow of said exhaust steam to said conventional environmental heating equipment;

a steam pressure regulator installed in said conduit to adjust the pressure of said diverted exhaust steam to a pressure suitable for use by said conventional environmental heating equipment; and conventional environmental heating equipment downstream of said steam pressure regulator that uses said exhaust steam for interior environmental heating purposes.

2. Apparatus according to claim 1, wherein said environmental heating system and said manufacturing process are located within the same manufacturing facility.

3. Apparatus according to claim 1, wherein said manufacturing process is for the manufacture of corrugated cardboard products.

4. Apparatus according to claim 1, further comprising check valve means in said conduit downstream of said steam pressure regulator to prevent the backward flow of steam to said manufacturing process.

5. Apparatus according to claim 1, further comprising a steam safety valve means in said conduit downstream of said steam pressure regulator to ensure that the pressure of the steam supplied to the environmental heating system does not exceed the level set by said steam pressure regulator.

6. Apparatus according to claim 1, wherein the pressure set by said steam pressure regulator is no more than about fifteen psi.

7. Apparatus according to claim 1, wherein said environmental heating equipment further comprises an auxiliary heating system to supplement the heat provided by said exhaust steam.

8. Apparatus according to claim 1, wherein at least some of said exhaust steam is not diverted to said conventional environmental heating equipment and is recycled for further use in the manufacturing process.

9. Apparatus according to claim 1, further comprising means for conveying steam emanating from said conventional environmental heating equipment back to a return tank for reuse in said manufacturing process.

10. Apparatus according to claim 1, wherein said diverting means comprises a T-joint, having an input port and two output ports, said input port being connected to said exhaust steam source, and a first of said output ports being connected to said conduit.

11. Apparatus according to claim 8, wherein said diverting means comprises a T-joint, having an input port and two output ports, said input port being connected to said exhaust steam source, a first of said output ports being connected to said conduit, and a second of said output ports being connected to a return tank of the existing manufacturing machinery.

12. Apparatus according to claim 10, wherein a second of said output ports being connected to a return tank of the existing manufacturing machinery.

* * * * *